United States Patent [19]

Stafford

[11] Patent Number: 4,950,388

[45] Date of Patent: Aug. 21, 1990

[54] SEPARATION OF MIXTURES IN A WIND TUNNEL

[75] Inventor: Robert G. Stafford, 17 King Street, Bayswater. W.A. 6053, Australia

[73] Assignee: Robert G. Stafford, Manning, Australia

[21] Appl. No.: 328,126

[22] PCT Filed: Jul. 16, 1987

[86] PCT No.: PCT/AU87/00222

§ 371 Date: Jan. 31, 1989

§ 102(e) Date: Jan. 31, 1989

[87] PCT Pub. No.: WO88/00861

PCT Pub. Date: Feb. 11, 1988

[30] Foreign Application Priority Data

Aug. 1, 1986 [AU] Australia ..... PH7242

[51] Int. Cl.[5] ..... B07B 9/00; B07B 4/02

[52] U.S. Cl. ..... 209/135; 209/147

[58] Field of Search ..... 209/134, 135, 146, 147, 209/149, 154; 222/406, 371; 198/817

[56] References Cited

U.S. PATENT DOCUMENTS

| | | | |
|---|---|---|---|
| 1,042,836 | 10/1912 | Stromberg | 209/135 |
| 1,420,593 | 6/1922 | Titchmarsh | 209/154 X |
| 1,834,981 | 12/1931 | Stebbins | 209/135 |
| 2,034,876 | 3/1936 | Morgan | 222/371 |
| 3,933,626 | 1/1976 | Stukel et al. | 209/142 X |
| 4,213,852 | 7/1980 | Etkin | 209/136 |
| 4,430,210 | 2/1984 | Tuuha | 209/254 X |
| 4,720,005 | 1/1988 | Beresinsky | 198/817 |

FOREIGN PATENT DOCUMENTS

| | | | |
|---|---|---|---|
| 1134941 | 8/1962 | Fed. Rep. of Germany | 209/134 |
| 639615 | 12/1978 | U.S.S.R. | 209/134 |
| 878356 | 11/1981 | U.S.S.R. | 209/135 |
| 324469 | 1/1930 | United Kingdom | 209/134 |
| 2009627 | 6/1979 | United Kingdom | 209/135 |

*Primary Examiner*—Donald T. Hajec

*Attorney, Agent, or Firm*—Harness, Dickey & Pierce

[57] ABSTRACT

An apparatus for the separation of a mixture of particulate material having particles of substantially the same particle size. The apparatus comprising a wind tunnel (10) having an entry and an exit. The exit is associated with a fan (14) for creating an air flow through the wind tunnel (10) from the entry to the exit. An inlet (18) is provided at the top side of the wind tunnel for introducing the particulate material into the wind tunnel whereby it can fall freely under the influence of gravity transverse to the air flow. A plurality of collectors (20) are spaced axially along the bottom of the wind tunnel, each collector extending transversely across the wind tunnel.

19 Claims, 6 Drawing Sheets

Figure 8
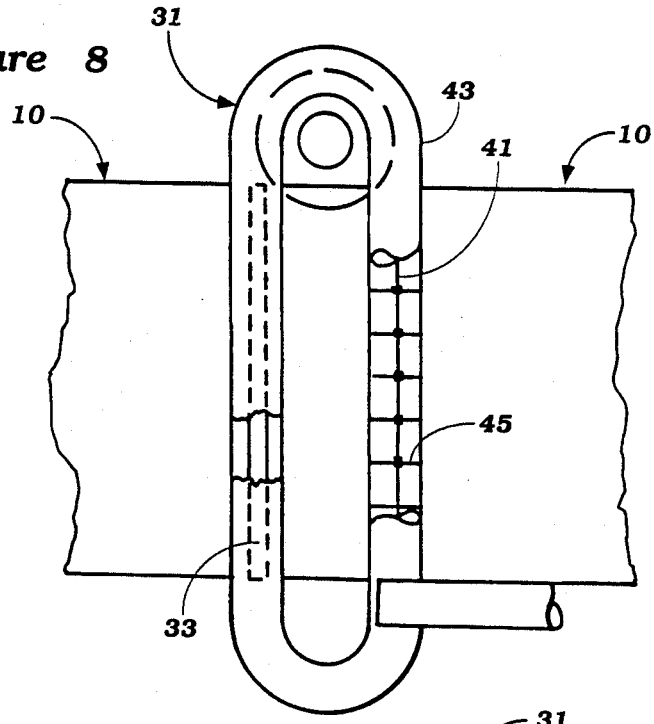
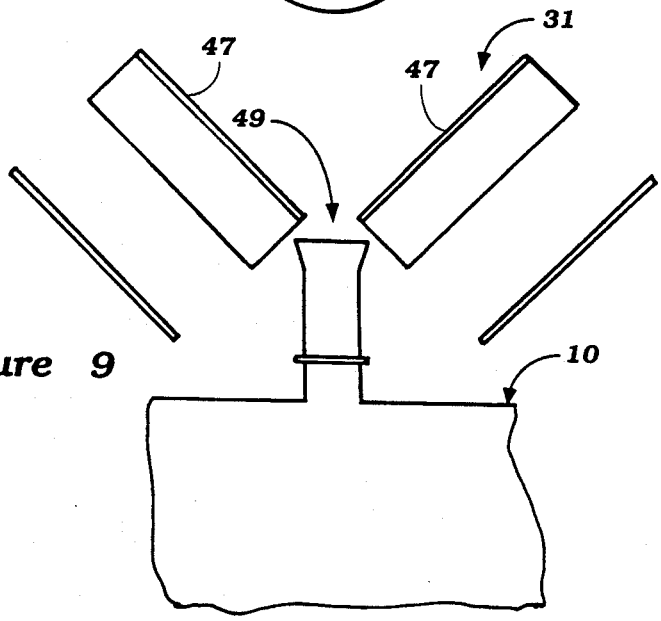
Figure 9

SEPARATION OF MIXTURES IN A WIND TUNNEL

BACKGROUND OF THE INVENTION

This invention relates to apparatus for the separating of mixtures in a wind tunnel.

In particular the apparatus relates to the separation of mixtures according to the specific gravity of the constituents of the mixture where the mixture has been graded according to size (i.e. sized) prior to the separation procedure. A particular application of the invention relates to the beneficiation of ores which may include gold ores, iron ore, coal, vermiculite, mica, metallurgical slag or other such material and tailings.

It has been proposed in the past to separate the constituents of a mixture having differing specific gravities by feeding the mixture into the top of a wind tunnel into a substantially stream line airstream through the tunnel and collecting different fractions of the materials in collectors arranged along the bottom of the tunnel, whereby constituents of lesser specific gravity are carried further along the wind tunnel than those of higher specific gravity.

One method of separation as disclosed in Australian Patent 520604 utilises a wind tunnel having an axial flow fan at the entry to the tunnel which provides the air flow through the tunnel. This arrangement, however, has been found to be cumbersome in that it requires a long transition section between the fan and the part of the tunnel in which the separation occurs in order to smooth out turbulence from the fan. The length of the transition zone is increased with an increased difference between cross-sectional area of the circular fan housing and the cross-sectional area of the square or rectangular wind tunnel. In such an instance, the air flow is not uniform across the wind tunnel even with a long transition zone.

An alternative proposal as disclosed in Australian Patent 545539 has been to utilise a centrifugal fan located at the entry to the wind tunnel which directs air transversely towards the entry. The air flow is subsequently redirected axially into the wind tunnel by means of deflectors and is streamlined by means of baffles. While the latter arrangement has the advantage of providing a wind tunnel of reduced axial dimensions in comparison to one utilising an axial fan, the use of deflectors to redirect the air flow from the fan results in difficulties in establishing a uniform laminar air flow under all flow conditions because the required deflector design varies with the air flow required to suspend material particles. This leads to losses in efficiency due to the need to establish increased pressure prior to the deflectors and baffles to overcome their resistance. The range of deflector designs required to accommodate the transportation of different particle sizes in parallel wind tunnel sections also creates difficulty in obtaining suitable fans to achieve optimum air volumes for each wind tunnel section.

Where tunnels according to each of the above proposals utilise air flow velocities ranging from 1.0 m/s to 7.0 m/s, it is possible (with some difficulty) to establish a reasonably streamlined flow through the tunnel by designing deflectors between the fan and tunnel. The design of the deflectors is based on trial and error since incremental changes in air flow do not involve corresponding incremental changes in shape or setting of the deflector elements. When the velocity of air is in excess of 7.0 m/s as is required for particle sizes above 3 mm, the air velocity is increased at the bottom of the plenum chamber in the region adjacent to the tunnel to such a degree that even with adjustable distribution plates there is non uniform air flow in the wind tunnel. Changes in plenum chamber geometry do not achieve uniform air flow for a range of air flows.

A further difficulty of each of the above proposals relates to the discharge of air which contains considerable amounts of residual inherent dust which can arise from the attrition of the material prior to screening or from the screening of the particulate material itself.

While each of the above prior art proposals has been found to operate satisfactorily under certain conditions, both have been found to be of a disadvantage where flexibility in use is required and where space is at a premium and portability is required. Furthermore, owing to transition zone requirements to produce uniform laminar air flows, the ability to increase the size of prior art separators is severely constrained.

A still further difficulty of each of the above proposals relates to the blinding of fine meshes, which are used to smooth out air flow, from insects, airborne particles and seeds which accumulate on the meshes thereby causing a restriction which lowers the air velocity relative to that selected.

SUMMARY OF THE INVENTION

According to the present invention, there is provided an apparatus for separation of a mixture of sized particulate material according to specific gravity, said apparatus comprising a wind tunnel having an entry and an exit, said exit being associated with fan means for creating an air flow through the wind tunnel from the entry to the exit, inlet means provided at top side of the wind tunnel for introducing material into the wind tunnel whereby it can fall freely under the influence of gravity transverse to the air flow, a plurality of longitudinally spaced collectors located below the inlet means and extending down stream therefrom, each collector extending transversely across the wind tunnel.

While the prior art proposals have been found to operate satisfactorily, the application of the process requires that the feed material has to be dedusted (fines removed) prior to screening to remove the burden of fines which would otherwise reduce the screening efficiency and to produce a clean product for feeding into the wind tunnel. However the process of screening itself generates attrition of particles and the dust so generated together with residual dust not removed either by de-dusting first or the action of separation by size in the screening process (which cannot be 100% efficient) ends up in the wind tunnel and is unacceptably discharged to atmosphere at the exit of the tunnel, giving rise to environmental problems.

According to a preferred feature of the invention a dust collection means is provided in association with the exit.

According to a further preferred feature of the invention the dust extraction means comprises a cyclone located between the exit and the fan means for creating the air flow.

According to a further preferred feature of the invention the dust extraction means comprises a filter between the exit and the fan means.

BRIEF DESCRIPTION OF THE DRAWINGS

The invention will be more fully understood in the light of the following description of one specific embodiment. The description is made with reference to the accompanying drawings of which:

FIG. 8 is a view similar to FIG. 6, showing another form of conveyor; and FIG. 9 is also a view similar to FIG. 6, showing still another form of conveyor.

DETAILED DESCRIPTION OF THE PREFERRED EMBODIMENTS OF THE INVENTION

Figure 1:
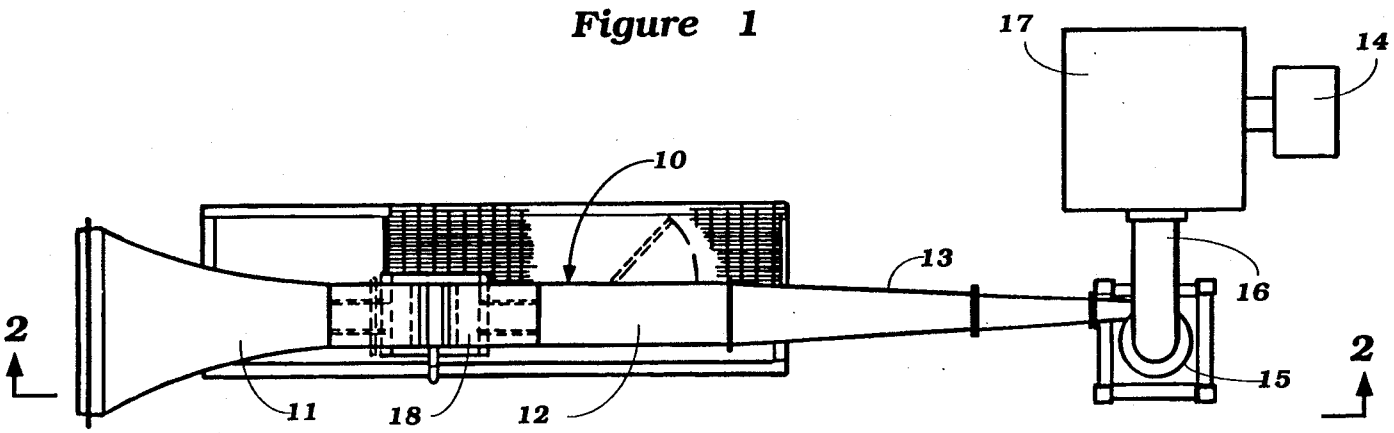
FIG. 1 is a plan view of the embodiment.
Figure 2:
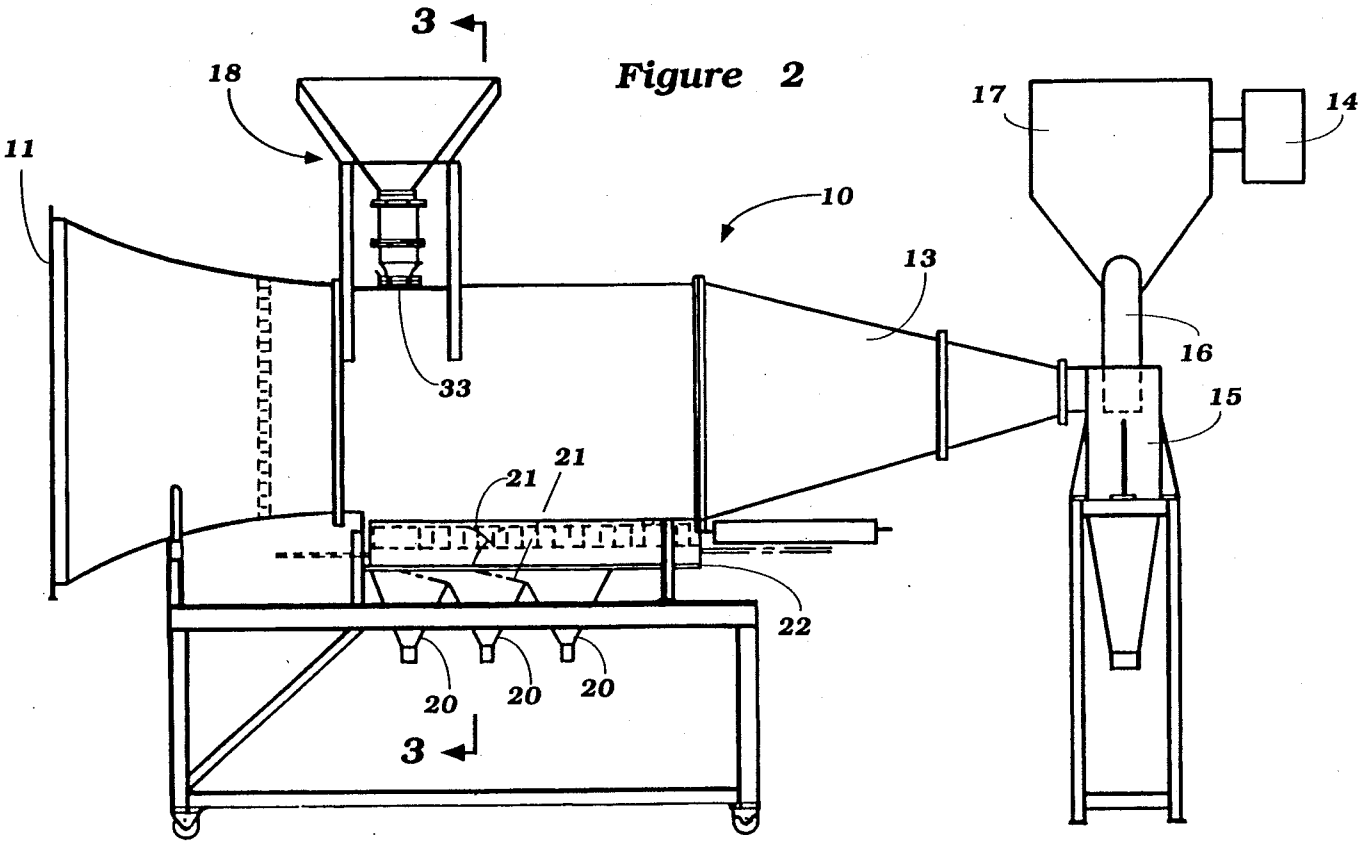
FIG. 2 is a sectional view along line 2—2 of FIG. 1.
Figure 3:
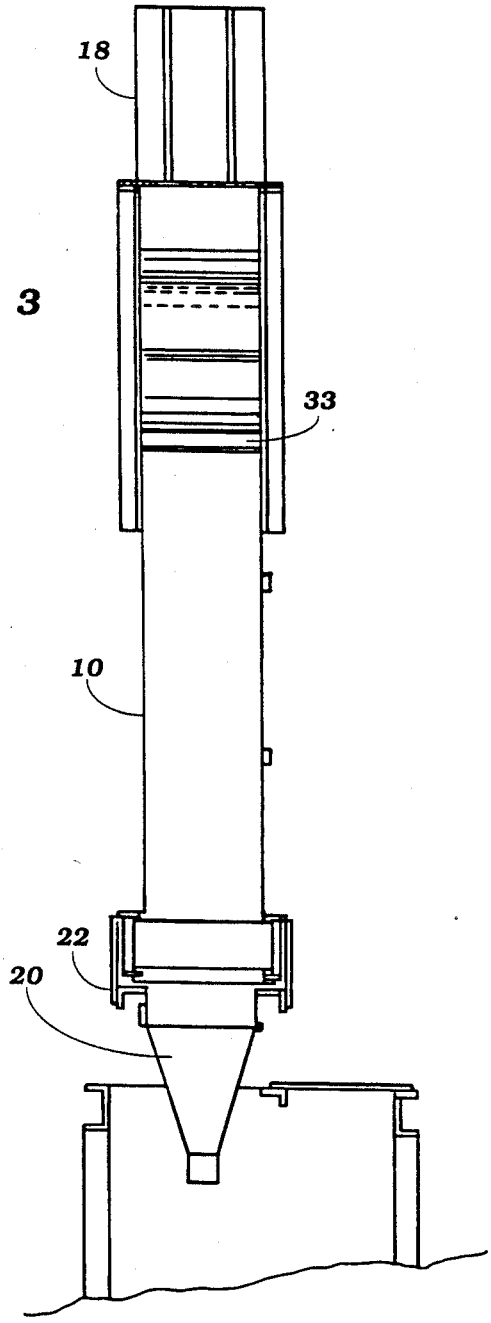
FIG. 3 is a sectional view along line 3—3 of FIG. 2.

The embodiment is directed to an apparatus for effecting the beneficiation of ores which may include waste materials requiring mineral processing such as metallurgical slag.

In operation, the apparatus would be associated with crushing means (not shown) and screening means (not shown) whereby the ore material is crushed to a suitable size to effect separation in apparatus of the type to be described and is screened according to a number of predetermined size ranges. The materials being delivered from a particular screen would then be delivered to a particular separating means whereby the sized particulate material can then be separated into its constituents according to specific gravity.

The separating means of the embodiment comprises a wind tunnel 10 having an entry section 11, a main section 12 and an exit section 13. The main section 12 is rectangular in cross-section. The exit section 13 is formed to converge and is connected at its outer end to a dust extraction cyclone 15 the air outlet of which is connected by ducting 16 to a bag filter 17. Communicating with the filter 17 is a fan housing 14 which may accommodate an axial or centrifugal fan or any other suitable means. The entry section 11 of the wind tunnel is of a flared configuration, converging in the direction of air flow to define an inlet bell. The opening into the entry section 11 may be provided with a plurality of deflection vanes (not shown) which serve to direct air flowing into the entry section into a substantially laminar flow pattern. Since the air flow into the wind tunnel 10 is effected through the full cross-section of the wind tunnel, there is less manipulation required of the air flow than would be required if the air flow were induced from the entry side of the wind tunnel and therefore the losses and inconsistencies created are less.

The wind tunnel 10 is associated with a feed material inlet means 18 at its upper side which delivers the particulate, sized ore material into the wind tunnel 10. The inlet means 18 extends transversely across the top of the wind tunnel 10 for substantially the full width of the wind tunnel 10 and the particulate material is allowed to fall freely under the influence of gravity across the wind tunnel. The floor of the wind tunnel 10 is associated with a plurality of longitudinally spaced collectors 20 which are located below and down stream from the inlet means 18. Each of the collectors 20 extends the full transverse width of the wind tunnel 10. The collectors are separated from each other by partitions 21 each of which is pivotally mounted at its lower edge about a transverse axis of the wind tunnel 10. The pivotal action of the partitions 21 of the collectors 20 provides for variation of the available selection area of each of the collectors 20 in order that the collection of the particulate material can be accommodated according to the degree of air flow through the wind tunnel 10 and the characteristics of the feed material being delivered into the wind tunnel 10. In addition, the pivotal movement of the partitions facilitates a variation in the angle of the partition to the stream of material in order to select the material collected at each chamber. Furthermore, the collectors 20 are jointly supported from the floor of the wind tunnel from a track 22 to be slidable axially thereon in order that the position of the collectors can be adjusted according to the trajectory and size of the material and the velocity of the air stream through the wind tunnel.

As a result of the air flow through the wind tunnel 10, the particulate material being deposited into the wind tunnel 10 is segregated according to specific gravity in that the constituents of lesser specific gravity or greater surface area as in flaky material are carried further along the wind tunnel than those of the higher specific gravity and those constituents having a range of specific gravity relevant to the specific gravity of the desired constituents of the ore may then be selected for subsequent processing.

Where a separator according to the embodiment is to process only material having little or no dust content, the cyclone 15, and in certain cases the filter 17, need not be provided. The provision of a cyclone 15 and filter 17 is however, of particular importance when separating material having a particle size less than 180 microns.

As a result of the construction of the embodiment, the degree of manipulation of the air flow required to produce a stream line laminar air flow through the wind tunnel 10 is less than that required in installations having a fan located at the inlet of the wind tunnel and therefore the construction of the separating device is less complicated than that of the prior art proposals discussed previously.

It has been found in the case of the embodiment, a laminar air flow is automatically established where there is an inlet bell of approximate dimensions which may equate to 4:1 area with that of the wind tunnel in which the separation occurs. This avoids the need for trial and error distribution plates as in the case of the prior art wind tunnels and a laminar air flow occurs at any set velocity from 0.5 m/s to 15.0 m/s both vertically from the top of the tunnel to the bottom and laterally from side to side with the exception of minor drag on the internal walls. This also obviates the need for screen meshes which are used in the prior wind tunnels to redistribute the air after straightening.

In addition, the capacity of the wind tunnel separation method can be increased more readily with the embodiment in comparison to prior art devices due to difficulties in the latter devices in achieving laminar flow in a wide wind tunnel which utilises a multiplicity of fans. Indeed, the wind tunnel separation method performed by the embodiment can be increased in capacity to achieve operation outside the known limits (as mentioned hereinbefore) of the prior art separators.

Figure 4:
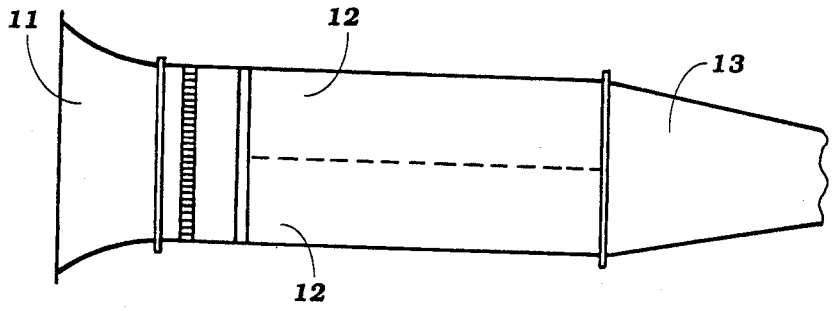
FIG. 4 illustrates a variation to the embodiment in which two wind tunnels are employed.
Figure 5:
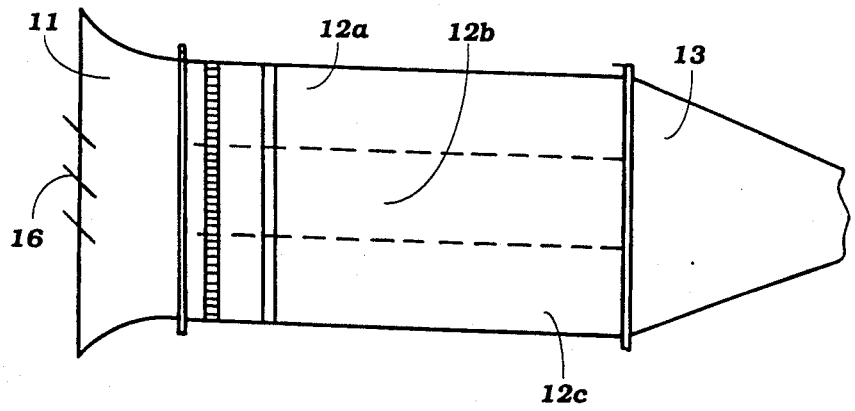
FIG. 5 illustrates a further variation in which three wind tunnels are employed.

To increase the capacity of the embodiment, a number of wind tunnel main sections 12 may be located side by side as shown in FIGS. 4 and 5 which each utilise a common entry section 11, exit section 13 and fan. In the instance of a triple wind tunnel, as shown at FIG. 5, if the velocity of the air is greater in the central wind tunnel section **12*b* then in the side sections 12*a* and 12*c*, the collectors associated with that tunnel can be adjusted to compensate. Additionally, the entry section 11 may also be provided with inlet dampers 16** to regulate the air flow through the central tunnel section to provide for a complete shut off of inlet air if desired and to vary inlet air flow precisely to the desired velocity.

The delivery of material to the inlet 18 is such that a substantially uniform curtain of material is delivered into the wind tunnel across substantially the full width of the tunnel. More particularly, the curtain of material is delivered across that part of the tunnel where streamlined air flow exists. There is a region immediately adjacent to each wall of the wind tunnel where the flow is not uniform owing to drag arising from the affect of the boundary surface on the air flow. The curtain of material preferably terminates inwardly of each side wall of the tunnel so as not to extend into the affected region of the air flow.

Figure 6:
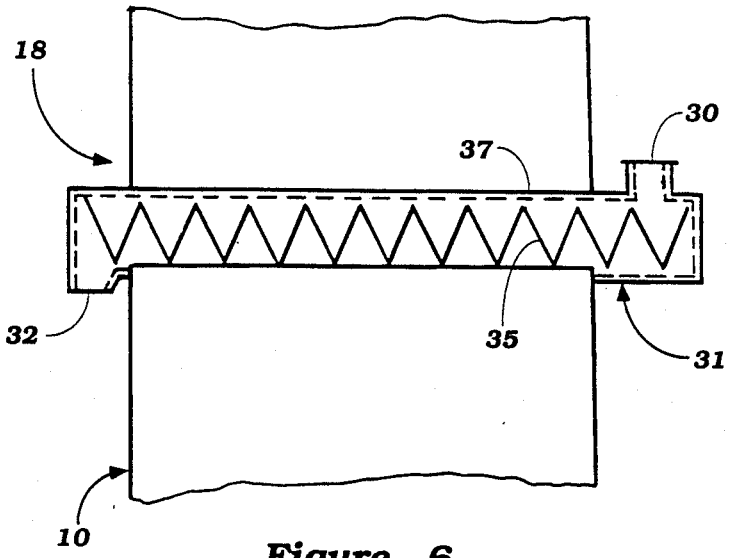
FIG. 6 is a plan view of part of the embodiment, showing particularly a conveyor for conveying particulate material along a discharge orifice opening into the wind tunnel.
Figure 7:
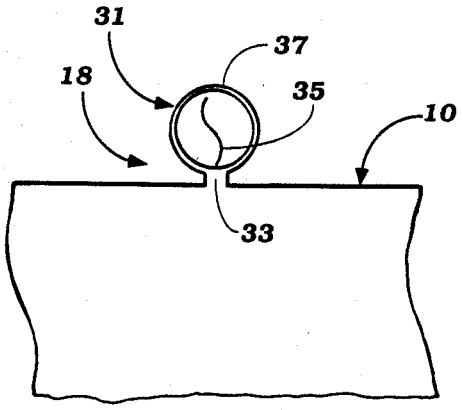
FIG. 7 is an end view of the conveyor shown in FIG. 6.

One means of producing such as curtain or material is illustrated in FIGS. 6 and 7 of the drawings and comprises a conveyor 31 at the lower end of the inlet means 18 having a narrow discharge orifice 33 extending across and opening into the wind tunnel. The conveyor includes an intake end 30 and a discharge end 32. The conveyor 31 carries material along the full length of the discharge orifice 33 and excess material is discharged at the discharge end of the conveyor. The discharge orifice 33 may be adjustable in width to selectively control the volume feed rate of material delivered into the wind tunnel. Where a multiplicity of wind tunnels are used, as shown in FIGS. 4 and 5, the conveyor carries material across the width of the set of tunnels, the orifice 33 being closed at intervals along its length corresponding to the locations of tunnel walls so that no material is delivered into the region adjacent each wall where air flow is affected by the wall as previously described.

In the arrangement illustrated in FIGS. 6 and 7, the conveyor 31 is in the form of a screw conveyor comprising a feed screw 35 within a casing 37. A slot in the lower end of the casing 37 provides the discharge orifice 33.

In another arrangement, which is shown in FIG. 8, the conveyor 31 comprises an endless band 41 movable through a circuitous path in a casing 43 having a slot which defines the discharge orifice. The endless band 41 has paddles 45 spaced along its length to convey material through the housing.

In still another arrangement, which is shown in FIG. 9, the conveyor 31 comprises a pair of opposed flat belt conveyor runs 47 which are angled to define a trough therebetween to receive and convey material and which are spaced to provide a discharge opening 49 communicating with the discharge orifice 33.

The embodiment provides the advantage over the prior art of enabling the separation of fine materials as indicated. A further advantage relates to the capacity of the embodiment to achieve laminar air flow at air velocities (e.g. less than 1.0 m/s) which can not be achieved in the prior art devices due to stall characteristics in blowing fans and distibution problems for low velocity air. The use of low velocity air flow becomes essential in the separation of particulate material between 150 microns and 30 microns in size. This feature coupled with the scope for increased capacity as a result of the possibility to utilise a plurality of parallel wind tunnels having a common entry and exit makes it possible to beneficiate fine ores containing substantial amounts of dust without any need for dust suppression which relies on added water.

An example of the embodiment has been constructed and tested to determine the feasibility of beneficiating coal contaminated with pyrites and ash of particle sizes between 4 mm and 2 mm.

A summary of the results are given in Table 1 below and the wind tunnel settings and screened coal product sizes are given at Table 2.

Such material was crushed and then dried in a fluidised bed. The resulting material was then screened. After screening, the sized material was fed to the appropriate one of three wind tunnels where the higher specific gravity material falls preferentially to the feed point to be collected and the lower specific gravity material was carried further downstream for separate collection. One sample of coal and ash fractions was collected from each wind tunnel for float/sink testing at a specific gravity of liquid of 1.6 to evaluate the efficiency cut by the separation process.

The results achieved as shown at Table 1 were quite satisfactory. For the wind tunnels over 85% of feed material could be classified as to an acceptable coal product. The reject ash material contained between 50–80% coal. As a result it was demonstrated that the wind tunnel according to the embodiment could effectively beneficiate coal.

It should be appreciated that the scope of the present invention need not be limited to the particular scope of the embodiment described above.

TABLE 1

| | | FINAL SEPARATION TEST RESULTS | | | | |
|---|---|---|---|---|---|---|
| | | COAL ACCEPT | | ASH REJECT | | |
| Wind Tunnel No. | Sample Weight (g) | Weight (g) | Sinks (grains) | Weight (g) | Approx coal Content (%) | Recovery (%) |
| 1 | 1038 | 964 | 15 | 74 | 80 | 92.9 |
| 2 | 936 | 712 | 15 | 124 | 80 | 86.2 |
| 3 | 516 | 482 | 8 | 34 | 50 | 93.4 |

NOTE: At 1.6 SG for the liquid

TABLE 2

| WIND TUNNEL SETTINGS | | | | |
|---|---|---|---|---|
| Wind Tunnel No. | Screen Designation (Mesh) | Product Size (mm) | Air Velocity (m/s) | Primary Flap Setting (mm) |
| 1 | 8 | −3.15 + 2.46 | 4.5 | 1040 |
| 2 | 7 | −3.522 + 3.15 | 4.7 | 1040 |
| 3 | 6 | −4.063 + 3.522 | 5.7 | 1030 |

The claims defining the invention are as follows; I claim:

1. Apparatus for the separation of a mixture of particulate material, said apparatus comprising a wind tunnel having an entry section, an exit section and a main section, fan means communicating with said exit section for creating a flow of air through wind tunnel from the atmosphere into the entry section through said main section and to the exit section, inlet means provided at a top side of the main section for introducing the particulate material into the main section across substantially the full width of the air flow for free fall under the influence of gravity, and a plurality of collectors spaced axially along a bottom side of said main section, each of said collectors extending transversely across said main section, said main section being substantially rectangular cross section width and height from the entry section to beyond said collectors and devoid of flow altering devices to minimize turbulence, and said entry section is open and is of a flared configuration converging in the direction of the air flow into said wind tunnel and being devoid of flow altering devices to minimize turbulence, the end of the entry section adjacent said main section and the end of the exit section adjacent said main section being of corresponding rectangular cross section to the cross section of the remaining section whereby the air flow through the main section is of substantially constant velocity across the cross section of the main section and is substantially laminar in nature.

2. An apparatus as claimed in claim 1 wherein a dust collection means is provided in communication with the exit section.

3. An apparatus as claimed at claim 2 wherein the dust collection means comprises a cyclone located between the exit and the fan means.

4. An apparatus as claimed at claim 3 wherein the dust collection means includes a filter between the cyclone and the fan means.

5. An apparatus as claimed at claim 2 wherein the dust collection means comprise a filter located upstream of the fan means.

6. An apparatus as claimed at claim 1 wherein the entrance to the entry section is provided with a plurality of damper blades located across the entry section to be movable to control the magnitude and uniformity of the air flow through the entry section.

7. An apparatus as claimed at claim 1 wherein the inlet means is located adjacent to the entry section and is provided with a discharge orifice extending transversely across and opening into the main section.

8. An apparatus as claimed at claim 7 wherein a conveyor is provided above the discharge orifice for conveying particulate material along the length of the discharge orifice.

9. An apparatus as claimed at claim 8 wherein the conveyor comprises a screw conveyor having a feed screw within a casing, the casing being provided with a slot defining the discharge orifice.

10. An apparatus as claimed at claim 8 wherein the conveyor comprises a pair of opposed belt conveyor runs defining a trough therebetween to receive and convey particulate material, the belt conveyor runs being spaced to define a discharge opening at the bottom of the trough.

11. An apparatus as claimed at claim 8 wherein the conveyor comprises a screw conveyor having a feed screw within a casing, the casing being provided with a slot defining the discharge orifice.

12. An apparatus as claimed at claim 8 wherein the conveyor comprises a pair of opposed belt conveyor runs defining a trough therebetween to receive and convey particulate material, the belt conveyor runs being spaced to define a discharge opening at the bottom of the trough.

13. An apparatus as claimed at claim 8 wherein the conveyor comprises an endless elongate member having a portion passing through a casing, the endless elongate member being adapted to move particulate material through the casing and the casing having a slot defining the discharge orifice.

14. An apparatus as claimed at claim 13 wherein members are provided on the endless elongate member to facilitate movement of the particulate material through the casing.

15. An apparatus as claimed at claim 8 wherein the conveyor comprises an endless elongate member having a portion passing through a casing, said endless elongate member being adapted to move particulate material through the casing and the casing having a slot defining the discharge orifice.

16. An apparatus as claimed at claim 15 wherein members are provided on the endless elongate member to facilitate movement of the particulate material through the casing.

17. An apparatus as claimed at claim 7 wherein means are provided for varying the width of the discharge orifice.

18. An apparatus as claimed at claim 1 wherein the collectors are separated by partition members which extend transversely across the main section and are pivotable to vary the available area of each collector to the stream of particulate material.

19. An apparatus as claimed at claim 1 wherein the collectors are adjustable along the length of the main section.

* * * * *